US010040610B2

(12) United States Patent
Tremayne et al.

(10) Patent No.: US 10,040,610 B2
(45) Date of Patent: Aug. 7, 2018

(54) CLOSURE WITH A SURFACE TENSION SEAL

(71) Applicants: Terry Tremayne, Victoria (AU); Kris Mastalerz, Victoria (AU)

(72) Inventors: Terry Tremayne, Victoria (AU); Kris Mastalerz, Victoria (AU)

( * ) Notice: Subject to any disclaimer, the term of this patent is extended or adjusted under 35 U.S.C. 154(b) by 194 days.

(21) Appl. No.: 14/890,158

(22) PCT Filed: May 9, 2014

(86) PCT No.: PCT/AU2014/000508
§ 371 (c)(1),
(2) Date: Nov. 9, 2015

(87) PCT Pub. No.: WO2014/179837
PCT Pub. Date: Nov. 13, 2014

(65) Prior Publication Data

US 2016/0114943 A1 Apr. 28, 2016

(30) Foreign Application Priority Data

May 10, 2013 (AU) ..... 2013901653

(51) Int. Cl.
*B65D 51/14* (2006.01)
*B65D 39/02* (2006.01)
(Continued)

(52) U.S. Cl.
CPC ..... *B65D 51/145* (2013.01); *B65D 39/02* (2013.01); *B65D 41/045* (2013.01); *B65D 53/04* (2013.01); *B65D 53/06* (2013.01)

(58) Field of Classification Search
CPC .... B65D 51/145; B65D 53/06; B65D 41/045; B65D 39/02; B65D 53/04
(Continued)

(56) References Cited

U.S. PATENT DOCUMENTS 1,468,208 A * 9/1923 Mueller ..... B65D 53/06 215/233
4,122,964 A * 10/1978 Morris ..... B65D 51/145 215/200
(Continued)

FOREIGN PATENT DOCUMENTS

EP 1549556 7/2005
GB 507702 A 6/1939
(Continued)

OTHER PUBLICATIONS

International Search Report for PCT/AU2014/000508 dated Jul. 29, 2014 (3 pages).

*Primary Examiner* — James N Smalley
(74) *Attorney, Agent, or Firm* — Michael Best & Friedrich LLP

(57) ABSTRACT

A closure for a glass container arranged to contain flowable content, the container defining a first extremely flat annular surface, the closure comprising a sealing disc made of hard material adapted to sit across the annular surface, the disc defining a second extremely flat surface, retaining means to urge the first and second extremely flat surfaces into parallel abutting contact and to prevent lateral movement of the disc relative to the first surface, the extremely flat surfaces adapted to form a surface tension seal when they are urged into parallel abutting contact wherein a wetting agent is provided between the extremely flat surfaces at the abutting contact of the surfaces.

20 Claims, 3 Drawing Sheets

(51) Int. Cl.
*B65D 53/04* (2006.01)
*B65D 41/04* (2006.01)
*B65D 53/06* (2006.01)

(58) Field of Classification Search
USPC ..... 215/228, 274
See application file for complete search history.

(56) References Cited

U.S. PATENT DOCUMENTS

| | | | | |
|---|---|---|---|---|
| 2006/0151422 | A1 | 7/2006 | Manley | |
| 2010/0065528 | A1 | 3/2010 | Hanafusa et al. | |
| 2015/0060389 | A1* | 3/2015 | Bolger ..... | B65D 39/0052 215/355 |

FOREIGN PATENT DOCUMENTS

| | | | |
|---|---|---|---|
| WO | 1996002433 | A1 | 2/1996 |
| WO | 2010105312 | | 9/2010 |

* cited by examiner

CLOSURE WITH A SURFACE TENSION SEAL

INTRODUCTION

This invention relates to a closure and more particularly a closure incorporating a surface tension seal. The closure is specifically designed for containers that contain liquid, powder or pastes, and for example could be a wine bottle.

BACKGROUND OF THE INVENTION

A major technical issue in the wine industry is the unpredictable incidences of problems that occur once wine has been bottled due to the properties of the closures used.

Traditional cork closures have problems with taint, caused in a major part by Trichloroanisoles (TCA) known more commonly as corked taint or causing "corked wine". It has been estimated that the wine in up to 10% of all bottles of wine produced worldwide may be affected in this manner. A more recently recognised problem with using cork as a closure is the physical nature of cork having variability to the permeation of oxygen which can lead to inconsistent and uneven development of the bottled wine. Leakage has always been as issue associated with cork caused by a fault line or lines or porosity in the cork.

The continued and increasing dissatisfaction amongst wine makers with the performance of natural cork as a closure has led to some use of synthetic material and varying forms of approach such as the screw top "STELVIN™" cap. There have been issues of taint and other performance issues from synthetic materials and the screw type closures and there is limited experience and testing of the performance of these materials. There is also considerable market resistance to the use of synthetic materials.

In EP 1549556 there is disclosure of a closure which uses surface tension to effect a seal. The seal takes place between two very flat abutting surfaces. In one embodiment of EP 1549556 the top of a glass wine bottle is polished to a flatness of 2 to 3 wavelengths of light and a glass disk of similar flatness is put on top of the bottle with pressure applied to create a seal. Although in a production environment there are technologies to produce very flat surfaces in materials such as glass and ceramics it is has proven very difficult to consistently achieve a flat surface that doesn't include imperfections, i.e. cavities, scratches etc. The presence of surface imperfections that are particularly prominent in certain production environments results in the seal lacking the quality desired when used as a closure for wine bottles.

It is these issues that have brought about the present invention.

SUMMARY OF THE INVENTION

According to one aspect of the invention there is provided a closure for a glass container arranged to contain flowable content, the container defining a first extremely flat annular surface, the closure comprising a sealing disc made of hard material adapted to sit across the annular surface, the disc defining a second extremely flat surface, retaining means to urge the first and second extremely flat surfaces into parallel abutting contact and to prevent lateral movement of the disc relative to the first surface, the extremely flat surfaces adapted to form a surface tension seal when they are urged into parallel abutting contact wherein a wetting agent is provided between the extremely flat surfaces at the abutting contact of the surfaces.

Preferably, the extremely flat surfaces are polished to a flatness of 2 to 3 wavelengths of light.

The wetting agent preferably has any one or more of the following characteristics:

1. Low oxygen transmission rate (OTR);
2. Low viscosity
3. Low surface tension
4. Water repellent and low water saturation rate
5. Compressible
6. Low slippage or migration
7. Non toxic
8. High Purity Preferably, the wetting agent has the capacity to maintain all of the characteristics described above for more than 50 years.

Preferably the wetting agent should operate effectively at temperatures between 5° C. to 60° C. for unpasteurized fluids and 5° C. to 100° C. for pasteurized fluids.

In a preferred embodiment the wetting agent comprises one or a combination of the following:

synthetic oils such as silicone oil,
mineral oil such as paraffin,
vegetable oil such as olive oil, grape seed oil, soybean oil, sunflower oil;
beeswax oil;
anti-slippage compound such as silicone powder.

In a preferred embodiment one or both the sealing surfaces are grooved.

Preferably the sealing surfaces have three spaced annular grooves. Each groove is preferably 0.5 mm wide and deep.

In a preferred embodiment an external seal is placed over the external join of the two flat surfaces.

DESCRIPTION OF THE DRAWINGS

Embodiments of the present invention will now be described by way of example only with reference to accompanying drawings in which.

DESCRIPTION OF THE EMBODIMENTS

The embodiments described herein relate to closures for containers utilising a surface tension seal.

In a preferred embodiment these closures are for the purpose for sealing a wine bottle.

In European Patent No. 1549556 there is disclosure of a number of embodiments of closures specifically for use for wine bottles. The entire disclosure of EP1549556 is incorporated herein by reference.

Figure 1:
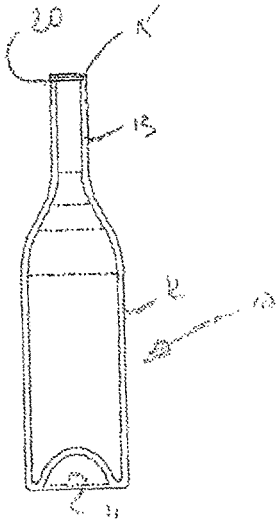
FIG. 1 is an elevational view of a wine bottle sealed with a surface tension seal.

FIG. 1 illustrates a glass wine bottle 10 with a base 11, cylindrical wall portion 12 and elongate neck 13. The neck 13 ends in an annular lip 15 and the exterior of the neck is threaded to locate a screw cap 20 that screws onto the end of the bottle. It is understood that other retaining devices are also envisaged to provide a retaining means to urge the closure against a bottle opening.

Figure 2:
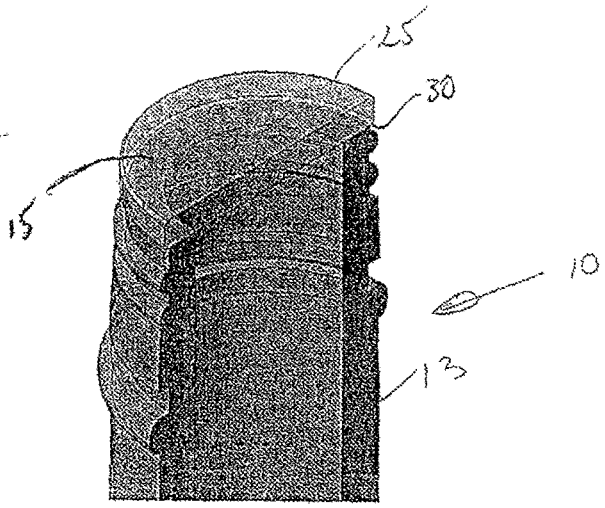
FIG. 2 is a perspective view of the top of the bottle with a screw cap removed.
Figure 3:
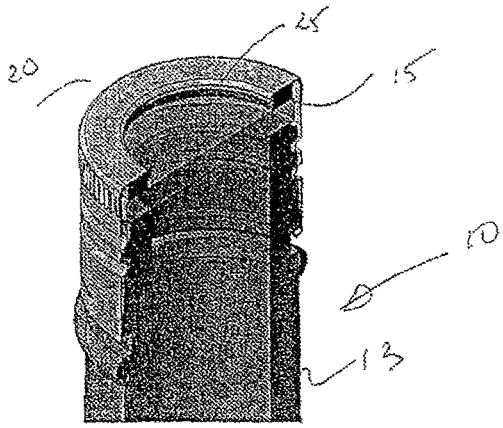
FIG. 3 is a perspective view of the top of the bottle with the screw cap screwed onto the neck of the bottle.

As shown in FIG. 2 a flat disc 25 of glass or other hard ceramic material is situated on top of the annular lip 15 of the bottle 10 and is pressed into engagement with the bottle 10 by the interior of the screw cap 20 when the screw cap is screwed onto the threaded end of the neck 13 of the bottle 10. The annular lip 15 on the top of the neck of the bottle and the underside 30 of the flat glass disc have been polished to an extreme flatness that is a flatness of between 2 and 3 wavelengths of light. This extreme flatness as the adjacent surfaces are pushed together causes a surface tension seal that can, in ideal situations, remain for very lengthy periods such as, greater than fifty years.

The surface tension seal prevents leakage of liquid, but also provides an anoxic seal that is a seal that allows no entry of air. In a production environment where bottles such as wine bottles are mass produced it is very difficult to consistently achieve the surface finish that is required to provide the surface tension seal described above. Manufacturing processes tend to result in the surface containing cavities, scratches and other imperfections that break down the quality of the seal.

When the abutting surfaces that provide the surface tension seal are coated in a suitable wetting agent it has been discovered that once the surfaces are pressed together the pressure on the surfaces as well as capillary action causes the wetting agent to fill the cavities and scratches creating an anoxic seal which has a capacity to remain effective over extreme length of periods such as fifty years.

Figure 4:
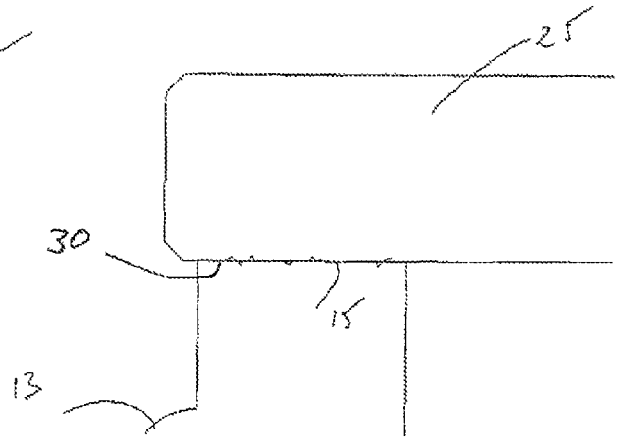
FIG. 4 is a cross-sectional view of part of the neck of the bottle showing a flat disc in abutting contact with a lip of the neck.
Figure 5:
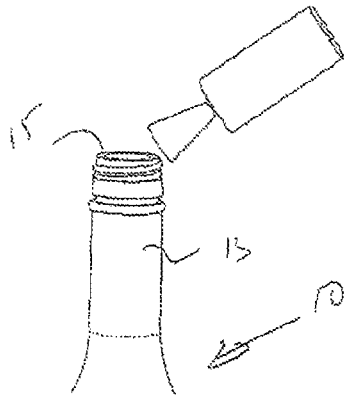
FIG. 5 is a perspective illustration of a means of applying wetting agent to the lip on the neck of the bottle.

FIG. 4 is an illustration of the join between the flat disc and the lip of the neck of the bottle showing the imperfections that are filled with the wetting agent. FIG. 5 is an illustration of spraying the wetting agent onto the lip 15 of the neck of the bottle 10.

It is important that the wetting agent has certain characteristics that are described hereunder. The wetting agent has the characteristics that when the two surfaces are pushed together with sufficient force, the wetting agent is placed under pressure and there is also the creation of a capillary action that caused the wetting agent to fill any imperfections of the extremely flat surfaces. This results in an anoxic seal, but also provides an opportunity for facilitating controlled oxygen ingress. In cork closures of wine bottles it is typical to have an oxygen transfer rate (OTR) of between 0.0005 to 0.002 CC per day. With the present surface tension seal it has been discovered that there is an opportunity of controlling the OTR by adjusting the mix of the components and characteristics of the wetting agent. In testing it was discovered that the OTR of a wet surface is 100 times less than that of a dry surface. It was also discovered that the OTR of wet surfaces is far more consistent over time than is the case for dry surfaces.

Properties of the Wetting Agent

1. Low Oxygen Transmission Rate (OTR).

By volume the wetting agent should contain less than 15% oxygen. The wetting agent should not absorb or allow transmission of oxygen to ensure minimal oxidization of the contained liquid. The solubility of oxygen in most liquids is temperature-dependent. The oxygen ingress resistance of the wet barrier thus increases as the temperature increases, because less and less oxygen can be dissolved in the liquid barrier. Thus, as temperature increases the quality of the seal increases. In a preferred embodiment the wetting agent should create a barrier resistant to oxygen transfer allowing an OTR of between 0.00001 cc/day and 0.002 cc/day.

2. Low Viscosity

The lower the viscosity the more readily the wetting agent flows into the imperfections between the flat surfaces and under pressure creates a better capillary action, and thus a better sealing effect. An anoxic seal can be achieved with viscosities of between 50 and 10,000 cSt. Furthermore, the wetting agent could be a combination of different liquids and/or compounds each with varying viscosities to ensure the correct OTR for the liquid under containment.

3. Low Surface Tension

The wetting agent needs to be evenly spread across the flat sealing surfaces and stay in place until the surfaces are applied to each other and force applied to start the capillary action. In a preferred embodiment the surface tension of the wetting agent must be between 15-30 mN/m at 20° C.

4. Water Repellent and Low Water Saturation Rate.

To ensure that the wetting agent seal is not broken down by the liquid contained in the container or the moisture outside of container, the wetting agent must by highly water repellent with very low water saturation rate.

5. Compressible.

Liquids with very low compressibility are less suitable wetting agents as, under pressure they could be expressed from the high points reducing lubricating or sealing qualities. Mineral and vegetable oils have low compressibility and will work well, but silicone oil is highly compressible and will more readily fill any cavities in the flat surfaces thus enhancing the capillary action to express any air from the surfaces and improving the seal.

6. Non Toxic.

For vessels containing liquids for human consumption the wetting agent must be non toxic, e.g. approved by the FTA. This requirement would not be applicable for vessels containing liquids not for human consumption.

7. Long Life (i.e. Capacity to Last More than 50 Years).

The wetting agent must retain the preferred sealing characteristics discussed above for the life of the liquid under containment. Furthermore, it must not go rancid, or oxidize during the containment period as this could taint the flavor or even destroy the liquid contained therein. Vegetable oils have a recommended life of 2-5 years and thus should only be used as a wetting agent for where liquids are held in the container for consumption within 2-5 years. Mineral oils and synthetic oils as well as beeswax can be used as the wetting agent because they have an effective life of greater than 100 years.

8. High Purity.

The wetting agent must be free of any large particles and contaminants to thus improve the sealing and longevity of the wetting agent components. Consequently, the wetting agent must be highly processed by filtering and like processes to remove contaminants.

9. No Migration/Slippage.

To both retain the quality of the seal and the qualities of the contained fluid, the wetting agent must not migrate from between the adjacent flat surfaces. This can be achieved by adding a non-slip compound to the wetting agent that does not affect the viscosity, e.g. silicone powder.

10. Operating Temperature.

The wetting agent must perform consistently across the required temperature range experienced by the liquid under containment. For example, with wine closures it is expected that seals operate correctly with temperatures ranging between 5 to 60° C. Most mineral and vegetable oils perform well in the range of 0 to 80° C. and the characteristics of silicone oil change little in the temperature range of between −20° C. to 300° C.

11. Retaining Force.

The closure force that pushes the two very flat surfaces together only needs a few kilograms to create the capillary action to express air/oxygen from between the surfaces and maintain the required seal, but to keep the seal from breaking due to vapour pressure from within the container a force of at least 20 kg should be applied to the top flat surface.

By varying the above characteristics within the specified ranges and/or combining different liquid forces a wetting agent can be created to provide varying levels of oxygen ingress to the contained materials over a specific period of time. In the instance of wine containment a winemaker would choose the wetting agent with properties that suit the specific wine characteristics over the intended containment period referred to above. The wetting agent may contain a combination of two or more of the following:

a. Synthetic oils and especially silicone oil;
b. Mineral oils especially paraffin;
c. Vegetable oils including olive oil, grape seed oil, soybean oil, sunflower oil;
d. Beeswax oil; and
e. Anti-slippage compound such as silicone powder.

The wetting agent must be applied to at least one of the flat surfaces, that is on the lip of the neck of the bottle, or onto the outer 2 mm of the flat disc. The volume required on each surface to create an anoxic seal is about 0.05 ml, which is approximately 0.007% by volume of a standard 750 ml wine bottle.

The wetting agent can be applied to the very flat surface of the bottle during the bottling process or at the end of the production of the bottles. The extremely flat disc can be coated with the wetting agent and positioned within the screw cap so that the surface of the glass disc and the wetting agent are protected until the cap is applied to the bottle.

Glass production environments are not sterile and dust free so that even if a flatness of between 2 to 5 wavelengths of light is created during the manufacturing process there will still be particles of dust, glass and other materials in the atmosphere that could fall into the bottle mould or onto a fairly hot (600° C.) molded bottle which would create small imperfections, cavities or bumps on the flat surface. These very small imperfections are big enough to reduce the quality of the seal of dry, flat surfaces, but large enough to hold the required amount of wetting agent.

To create an anoxic seal with a wetting agent between the two very flat surfaces the surfaces should have a flatness of between 2 and 10 wavelengths of light and a surface finish or polish with cavities of no more than 0.05 mm that is a finish achieved with 1000 grit diamond disc. Note by comparison to create an anoxic seal with no wetting agent between the flat surfaces would require a flatness of less than 2 wavelengths of light and surface polish of less than 0.001 mm.

There are a number of reasons why two flat surfaces containing a wetting agent should not be very highly finished or polished, namely:

a. if the two surfaces are extremely highly finished or polished most of the wetting agent could be expressed from the surfaces under the application force, causing the surfaces to fuse together which could make the closure almost impossible to open. It is for this reason the wetting agent has lubricating properties. With a level of flatness of between 2 to 10 wavelengths of light, cavities and imperfections in the finished polish of say 0.00002 mm to 0.05 mm there would be sufficient wetting agent retained between the two flat surfaces to act as an anoxic seal and lubricant when the top flat disc surfaces are twisted or rotated during opening of the seal.

b. another reason for varying the level of finish on one or both the flat surfaces is to alter the level of oxygen ingress to suit the specific requirements of the liquid being contained. For example, wine may require higher levels of oxygen ingress over a longer period and this can be provided with a lower level of polish on a flat surface with thus more wetting agent being trapped while still providing the liquid seal over lengthy storage periods.

c. transportation and handling of containers with seals of this kind can introduce shocks that can break the seal. For this reason the wetting agent must be sufficiently compressible to facilitate the capillary action when the two surfaces are forced together. This compressibility will also act to reduce the effect of impacts caused by shocks or downward forces which may be experienced during transportation and life of the sealed container.

As mentioned above, it is the different characteristics of wetting agents and the variation in finish of the extremely flat surfaces that allows the variation in the OTR level. One way of controlling this variation in OTR is to vary the width of the very flat surfaces on the top lip of the bottle that is by varying the width of from about 0.5 mm to 2.0 mm. Thus, by varying the width the amount of wetting agent increases which can result in a lower or higher OTR. Additionally, the sealing area for the wetting agent can be increased by deliberately creating one or more grooves in one of the flat surfaces. This modification could be used to vary the amount of oxygen ingress required for different liquids under containment or to increase the security of the seal whilst in storage or in transit.

In one example three microscopic grooves of approximately 0.5 mm wide and deep are formed into the face of one or more of the flat sealing surfaces thus ensuring that more wetting agent is trapped between the surfaces. If there are three microgrooves in the surface these will trap a specific volume of wetting agent with the outer and inner grooves protecting the central groove. The liquid trapped in the outer groove would be first to lose its sealing quality over an extended period of time due to the oxidization of the material due to some ingression of oxygen from the air around the container. The liquid in the inner groove may also oxidize depending on how much oxygen is contained inside the bottle at the time of bottling. However, generally over an extended period of time the liquid contained in the central groove would have the optimum protection from oxygen ingress provided by the materials in the inner and outer grooves.

In another embodiment, one or more of the grooves could contain a secondary seal of an O-ring, say of silicone, to further improve the quality of the seal. This O-ring could be comprised of a solid material such as metal or plastics, or semi-solid material for example silicone gel. The secondary seal could be made of a composite synthetic material.

In another embodiment, different types of wetting agents could be used in each of the microgrooves on the flat surfaces. If there are no grooves a different wetting agent could be applied on the inner part of the seal to that on the outer side of the seal area. This would facilitate further control of the level of oxygen ingress into the bottle.

In another embodiment different working materials could be applied in layers to create a similar result.

Figure 7:
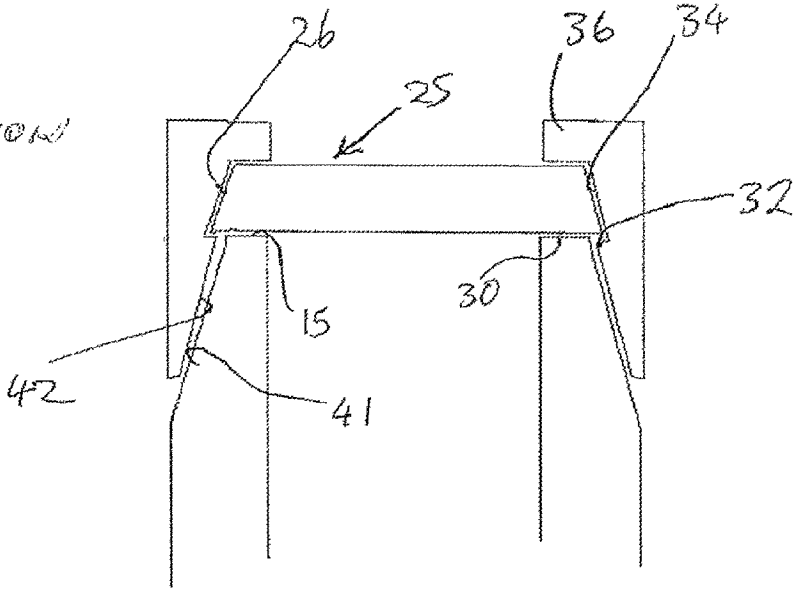
FIG. 7 is a schematic cross sectional view similar to FIG. 6 but illustrating a slightly different embodiment of the closure.
Figure 6:
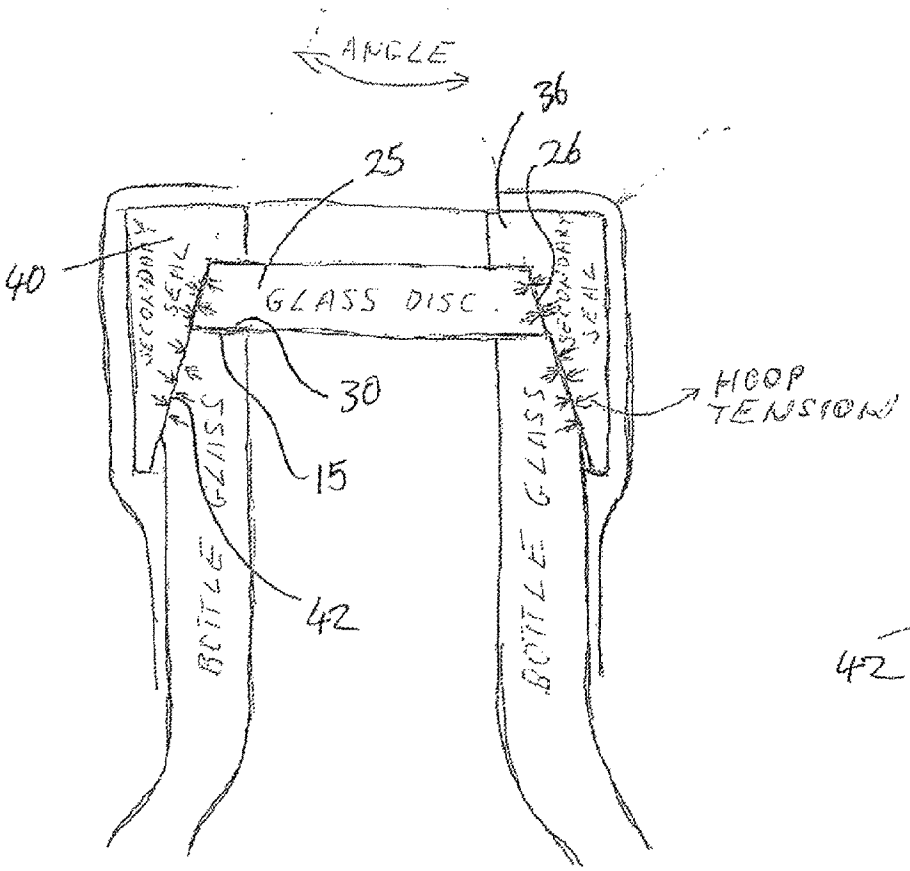
FIG. 6 is a cross sectional view of the top of a wine bottle illustrating a secondary seal.

To further ensure the quality of the seal over time an external secondary seal 40, shown in FIGS. 6 and 7 is included to prevent the wetting agent from escaping by slipping out from between the flat surfaces 15, 30 and eliminate evaporation of wetting agents that have high evaporative properties.

Preferably the external seal 40 is an annular body or ring and would cover from the top of the glass disc 25 down the outside of the disc past the junction point of where the two flat surfaces 15, 30 meet to just above the location where the thread for the cap starts on the container. The external seal 40 illustrated in FIG. 7 shows the seal 40 having a small lower lip 32 on an inside of the annular body to form an internal annular recess 34 (see FIG. 7) to hold the glass disc 25 in place so that the disc does not dislodge prior to the cap being applied to the bottle 10.

The seal 40 illustrated in FIG. 6 does not have a lower lip 32 but does have a larger upper lip 36 on the annular body that extends over the disc 25 to prevent the disc 25 from falling off the top of the bottle. The embodiment of the seal 40 of FIG. 7 has both an upper and lower lip 32, 36.

Furthermore, the seal 40 could be bonded to the inside of the retaining cap 20 to further ensure the retaining screw cap 20, external seal 40 and glass disc 25 are securely held together.

The external seal 40 can be made of one or more compressible synthetic materials that have low liquid permeability, and by selecting sealing materials with different oxygen transmission rates the OTR of the total closure system could be further tuned to the requirements of the liquid under storage.

As shown in FIGS. 6 and 7 the internal surface 42 of the seal is tapered to define a conical surface that engages a similarly tapered outer surface 41 of the neck 13 of the bottle 10. The glass disc 25 also has a tapered outer edge 26 so that when the cap is applied to the bottle the seal compresses against the bottle neck thus improving the quality of the seal.

Both the glass bottle (defined as an external taper) and the secondary seal ring (defined as an internal taper) are adapted to be placed against each other. Once the abutting two flat surfaces 15, 30 of the disc and bottle are pressed together the secondary external seal (with the internal taper) is moved down over the glass disc/bottle neck (with the external taper). As the diameter of the external taper increases, the bore of the internal taper must expand or stretch to accommodate a larger diameter at a lower point on the external taper. The expansion of the secondary seal is brought about as a characteristic of the material, namely in its resilient nature. This arrangement creates a hoop tension and thus a secondary seal that maintains a force on the disc 25 against the top surface of the bottle 15.

The retainer 20 could be a plastics cap, a stevlin cap, or foil cap, or any other means of retaining the disc onto a container.

What is claimed is:

1. A closure for a glass container arranged to contain flowable content, the container defining an annular first extremely flat surface, the closure comprising a sealing disc made of hard material adapted to sit across the first extremely flat surface, the sealing disc defining a second extremely flat surface, retaining means to urge the first and second extremely flat surfaces into parallel abutting contact and to prevent lateral movement of the sealing disc relative to the first extremely flat surface, the extremely flat surfaces adapted to form a surface tension seal when they are urged into parallel abutting contact wherein a wetting agent is provided between the extremely flat surfaces at the abutting contact of the surfaces, and an external surface of a join between the extremely flat surfaces is covered by a secondary seal located between the external surface and the retaining means, the secondary seal having an annular body and an upper lip and/or lower lip to retain the sealing disc against the first extremely flat surface.

2. The closure according to claim 1, wherein the extremely flat surfaces are polished to a flatness of between 2 and 10 wavelengths of light.

3. The closure according to claim 1, wherein the extremely flat surfaces are polished to a flatness of between 2 and 3 wavelengths of light.

4. The closure according to claim 1, wherein the wetting agent has an oxygen transmission rate of between 0.00001 cc/day and 0.002 cc/day.

5. The closure according to claim 1, wherein the wetting agent has a viscosity of between 50 and 10,000 cSt.

6. The closure according to claim 1, wherein the wetting agent has a surface tension of between 15-30 mN/m at 20° C.

7. The closure according to claim 1, wherein the wetting agent can operate effectively at temperatures between 5° to 60° C.

8. The closure according to claim 1, wherein the wetting agent comprises one or a combination of the following:

synthetic oil
mineral oil,
vegetable oil; or,
beeswax oil.

9. The closure according to claim 1, wherein one or both of the first and second extremely flat surfaces are grooved.

10. The closure according to claim 9, wherein the first and second extremely flat surfaces have three spaced annular grooves.

11. The closure according to claim 10, wherein each groove is approximately 0.5 mm wide and deep.

12. The closure according to claim 1, wherein the secondary seal is made of compressible synthetic material.

13. A bottle with a closure according to claim 1.

14. A glass container having a closure as defined in claim 1, wherein the first extremely flat surface of the container is an annular lip at the end of a neck of the container, and the secondary seal includes an internal taper that engages a similarly tapered outer surface of the neck of the container.

15. The closure according to claim 1, wherein the extremely flat surfaces have a surface finish or polish with cavities of no more than 0.05 mm.

16. The closure according to claim 1, wherein the secondary seal includes an internal taper and the sealing disc includes an external taper that contact each other.

17. A closure for a glass container arranged to contain flowable content, the container defining a first extremely flat surface, the closure comprising a sealing disc made of hard material adapted to sit across the first extremely flat surface, the disc defining a second extremely flat surface, retaining means to urge the first and second extremely flat surfaces into parallel abutting contact and to prevent lateral movement of the disc relative to the first surface, the extremely flat surfaces adapted to form a surface tension seal when they are urged into parallel abutting contact wherein a wetting agent is provided between the extremely flat surfaces at the abutting contact of the surfaces, and the wetting agent contains a non-slip compound.

18. The closure according to claim 17, wherein the non-slip compound is silicone powder.

19. The closure according to claim 17, wherein the wetting agent can operate effectively at temperatures between 5° C. and 60° C.

20. The closure according to claim 17, wherein the wetting agent comprises one or a combination of the following:

synthetic oil
mineral oil,
vegetable oil; or,
beeswax oil.

* * * * *